United States Patent [19]

O'Brien

[11] 4,170,793

[45] Oct. 16, 1979

[54] INNER GARMENT FOR AIDING EVAPORATIVE COOLING

[75] Inventor: Scott T. O'Brien, Arcadia, Calif.

[73] Assignee: Safariland Ballistics, Inc., Monrovia, Calif.

[21] Appl. No.: 910,295

[22] Filed: May 30, 1978

[51] Int. Cl.[2] ..... A41B 9/06

[52] U.S. Cl. ..... 2/113

[58] Field of Search ..... 2/113, 4, 97, 115, 81, 2/2.1 A; 428/231, 257, 152; 139/423; 112/420, 421, 422, 440, 441

[56] References Cited

U.S. PATENT DOCUMENTS

| | | | |
|---|---|---|---|
| 2,804,099 | 8/1957 | Sherman | 139/423 |
| 2,879,654 | 3/1959 | Evans | 2/113 X |
| 2,921,456 | 1/1960 | Evans | 66/196 X |
| 2,936,603 | 5/1960 | Lewine | 66/202 X |
| 3,335,763 | 8/1967 | Bellmore | 139/423 X |
| 3,559,209 | 2/1971 | Vail | 2/2.1 A |
| 3,710,395 | 1/1973 | Spano et al. | 2/81 |

*Primary Examiner*—Ronald Feldbaum

*Attorney, Agent, or Firm*—Christie, Parker & Hale

[57] ABSTRACT

An inner garment for aiding evaporative cooling includes a first sheet containing a substantial portion of cotton. One face of the first sheet is worn next to the skin where it acts as a wick for perspiration. A second sheet in the form of a resilient, wrinkled, porous web is disposed against the other face of the first sheet to form an evaporative cooling space when an outer garment is worn over the inner garment. Preferably, a perforated third sheet of woven thermopolastic fibers is disposed over the outer face of the wrinkled web to protect the web and restrict loss of moisture primarily to the evaporative process.

14 Claims, 3 Drawing Figures

INNER GARMENT FOR AIDING EVAPORATIVE COOLING

BACKGROUND OF THE INVENTION

This invention relates to an inner garment for promoting evaporative cooling.

Significant advances have been made in recent years in designing improved lightweight, flexible body armor. For example, U.S. Pat. No. 4,090,005, issued May 16, 1978, to Morgan describes lightweight, flexible body armor with projectile-stopping ability superior to that of the prior art. However, this body armor, as well as that of the prior art, impedes evaporative cooling from the skin, and thus discourages use of the armor, particularly in warm weather.

This invention provides a lightweight and flexible undergarment adapted to be worn under body armor, or any other kind of outer garment to provide a cooling space to promote evaporation of perspiration.

SUMMARY OF THE INVENTION

The inner garment of this invention includes a first sheet of cloth having an inner face and an outer face. The first sheet contains a substantial portion of cotton, and the inner face is adjacent the skin of one wearing the garment so the sheet acts as a wick for absorbing perspiration. A porous second sheet in the form of a wrinkled, resilient web is disposed adjacent the outer face of the first sheet. The web has a major plane and includes a plurality of web filaments interwoven to leave openings with dimensions in the major plane substantially greater than the transverse dimensions of the filaments. Means are provided for holding the web in a wrinkled condition with portions of the web filaments displaced out of the major plane to give the web an effective thickness at least several times greater than the transverse dimension of the web filaments to form a substantial air space between the first sheet and any article worn over the inner garment.

Preferably, the inner garment includes a porous third sheet secured around its periphery to the first sheet, and thus form a pocket which holds the wrinkled web. The third sheet is made of woven thermoplastic fibers, which are less hydrophilic than the fibers which make up the first sheet. The third sheet protects the wrinkled web, and also restricts the loss of perspiration primarily to the evaporative process.

In the preferred form, the wrinkled web is held in a wrinkled condition so portions of the web filaments are displaced out of the major plane of the web by tension filaments secured to the woven web at spaced intervals. The tension filaments are preferably a thermoplastic material, such as Nylon, which is elastic and has a "memory". The tension filaments are stretched, secured to the web at spaced locations in the stretched condition, and then released. The tension filaments then contract and cause the web to wrinkle or pucker, and thus give the web an effective thickness at least several times greater than the transverse dimensions of the web filaments to form a substantial air space between the first sheet and any article worn over the inner garment.

DESCRIPTION OF THE PREFERRED EMBODIMENTS

Figure 1:
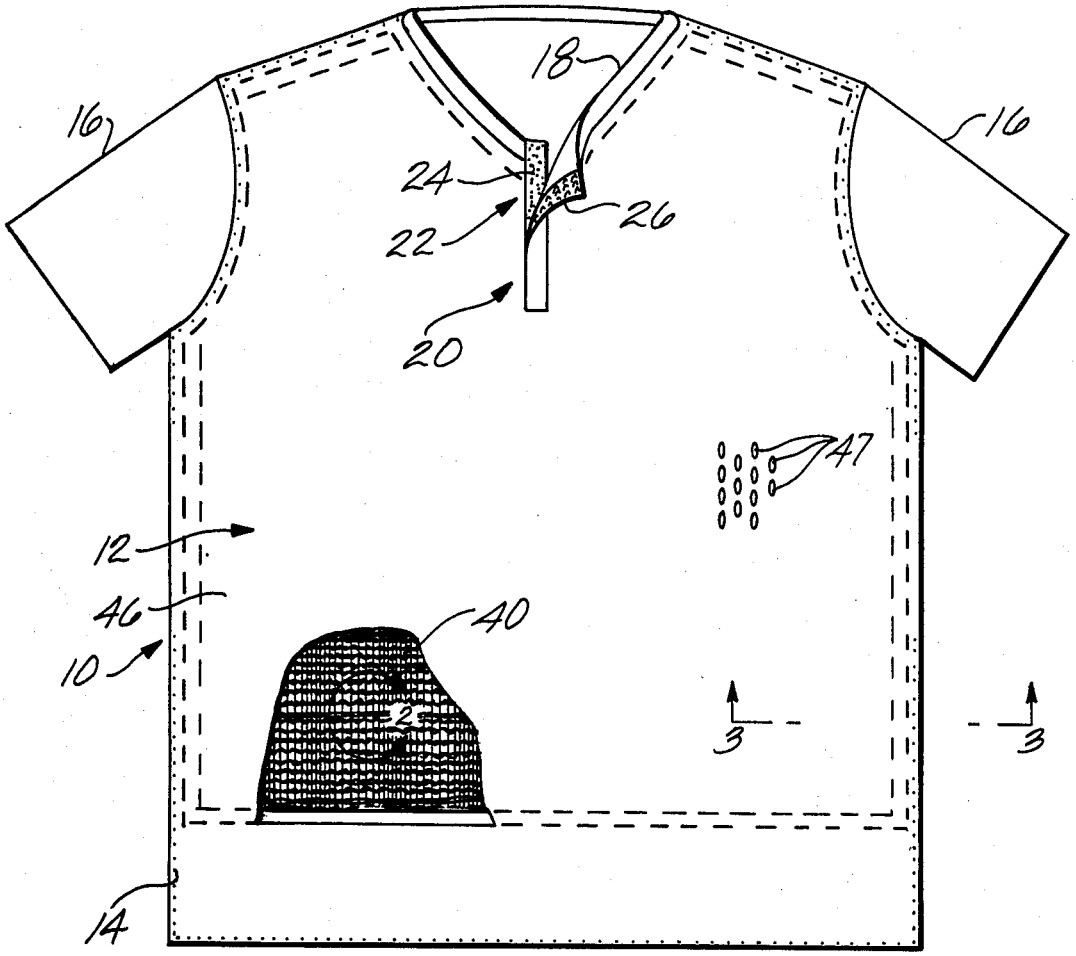
FIG. 1 is a front elevation of the inner garment of this invention fabricated in the form of a shirt.
Figure 3:
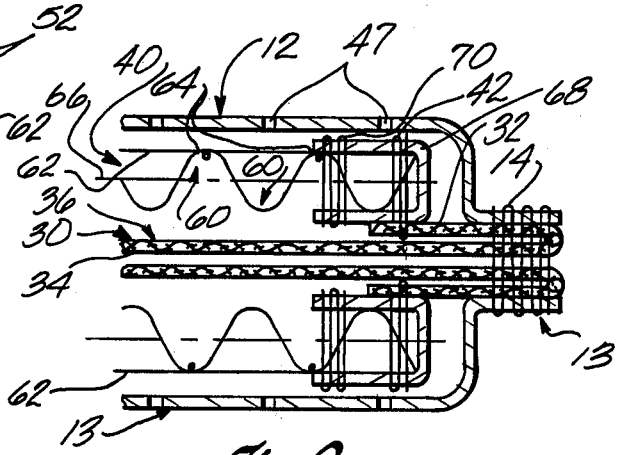
FIG. 3 is a view taken on line 3—3 of FIG. 1.

Referring to FIGS. 1 and 3, an inner garment 10, or shirt as specifically shown, includes a front panel 12 and a back panel 13. The front and back panels are generally identical rectangles secured together at their edges by stitching 14. The panels are conventional shape to form a shirt which has the usual sleeves 16 and neck 18. The front panel is slit at its uppr central portion 20 to provide a collar 22 with overlapping strips 24 and 26. The lower strip 24 carries a layer of Velcro thistlecloth pile, and the upper strip 26 carries a layer of Velcro thistlecloth hooks so that the collar can be easily opened and closed.

The front and back panels are substantially identical in construction, and therefore only the front panel will be described in detail. Referring to FIG. 3, the front panel includes a first sheet 30 of conventional material, say, a mixture of 50% cotton fibers and 50% polyester fibers by weight. Although the materials in the first sheet can vary considerably, it contains at least 20% cotton fiber to give it sufficient moisture-absorbing capacity to permit it to act as a "wick" in absorbing perspiration from the skin. The first sheet can be made entirely of cotton, although some man-made organic fiber is preferred to increase the strength and life of the sheet.

The outer edge of the first sheet is folded back on itself away from one wearing the inner garment to provide an overlapping border 32 which extends up each side of the sheet and across the top of the sheet to the outermost portion of the neck of the garment. Thus, the first sheet has an inner face or surface 34 which is disposed toward one wearing the garment and an outer face or surface 36 facing outwardly.

A porous, resilient, wrinkled web 40 of substantially identical shape as the first sheet is secured by stitches 42 to the overlapping border 32 of the first sheet. As shown best in FIG. 1, the wrinkled web is shorter than the first sheet, and therefore terminates a substantial distance above the bottom edge of the first sheet. Normally, the lower edge of the web is at about the beltline of the wearer, and the lower portion of the first sheet forms a "tail", which can be tucked in the pants of one wearing the shirt.

A third sheet 46 of substantially the same size and shape as the first sheet has a plurality of holes 47 through it, and is secured by the stitches 14 to the periphery of the first sheet so that the first and second sheets form an envelope which contains the wrinkled web or second sheet. The third sheet is preferably less hydrophilic than the first sheet to promote removal of moisture from the first sheet primarily by evaporation. For example, the third sheet may be made of thermoplastic fibers, such as polyester, or the like.

The first and second panels are secured together around their peripheries (except across the bottom) by the stitches 14 to form an inner garment or shirt which can be slipped on and off over the head of the wearer.

Figure 2:
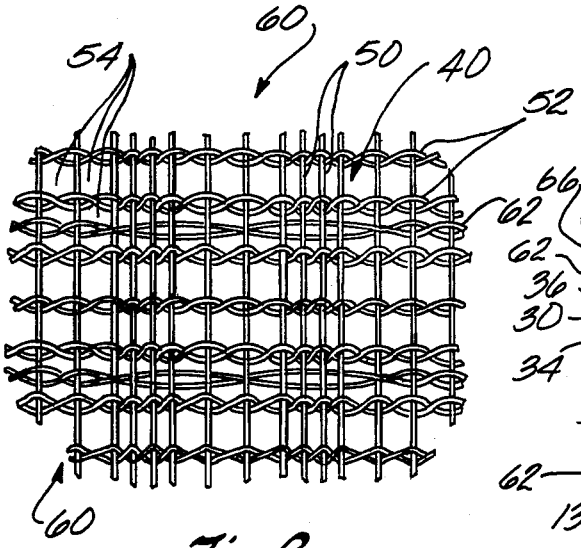
FIG. 2 is an enlarged view taken in the vicinity of 2—2 of FIG. 1.

The details of the second sheet or wrinkled web 40, which is commercially available, are best understood by referring to FIGS. 2 and 3. The web includes a plurality of vertical, laterally spaced monofilaments 50. A plurality of twisted pairs 52 of filaments extend horizontally at uniform spacing across the vertical filaments. Each one of the filaments in each pair 52 alternately goes over and under adjacent vertical filaments. The filaments in each pair also alternately pass over and under each other between adjacent vertical filaments. Thus, the vertical monfilaments and horizontal pairs of twisted filaments form a web or net with openings 54, which are substantially square in shape, and which are substantially greater, preferably at least 3 times greater, than the diameter of the filaments which form the web.

The web is held in a wrinkled or puckered condition so that a plurality of horizontally spaced, vertical ribs 60 extend the length of the web. The ribs are formed by pairs of tension filaments 62 secured to the vertical web filaments at the crests 64 of alternate ribs and are held in tension to prevent the web from assuming a flat shape. Thus, the web has a major plane 66 passing through the center of the ribs. The tension filaments hold the web in a wrinkled or puckered condition so that the web filaments are displaced out of the major plane of the web to give the web an effective thickness, at least several times greater than the transverse dimensions of the web filaments. For example, the filaments may be about 0.3 mm thick, and the effective thickness of the web (from the crest of one rib to the crest of an adjacent rib) is about 14 mm.

A binding 68, which is U-shaped in cross-section, as viewed in FIG. 3, is secured by stitches 70 to the entire periphery of the web to protect the web and provide means for securing the sides and top of the web with stitches 42 to the border 32 of the first sheet.

Preferably, the tension filaments are an elastic thermoplastic material, such as Nylon, which has a "memory", permitting the filaments to be stretched, and woven to engage the crests of alternate ribs while the tension filaments are stretched. After the weaving operation, the tension filaments are released so they contract and hold the web in ribbed configuration shown in FIGS. 2 and 3.

The web and tension filaments can be of any suitable organic plastic material, such as the various polycarbonates, polyamides, polyesters, acetal resins, and the like. Suitable materials are available under trademarks such as NYLON, MARLEX, DELRIN, KEVLAR, NOMEX, and DACRON.

The diameter of the web filaments can be of any suitable dimension, but preferably they are at least great enough to give the web sufficient stiffness or resiliency to return to the shape shown in FIG. 3 if the web is momentarily flattened or crushed. For example, the filaments may have a diameter between about 0.1 and about 2.0 millimeters. This permits the web to be sufficiently flexible to be worn comfortably, and yet have sufficient resilience to recover the shape shown in FIG. 3 within a few minutes after being subjected to compressive forces such as are normally encountered in the wearing of garments.

From the foregoing description, it will be understood that the inner garment or shirt can be put on by opening the collar and slipping the shirt over the head. The collar is then fastened by pressing the two mating strips of thistlecloth material together.

Since the web is secure only at its side and top edges to the border of the first sheet, the web is free to move relative to the first sheet and second sheet, thus making the entire inner garment flexible and comfortable to wear.

The inner garment may be worn by itself, say for various sport activities, and provide an efficient and cooling effect for the wearer. The third or outer sheet, when used, is held spaced from the first or inner sheet, and since the outer sheet contains a plurality of openings, there is ample ventilation to promote evaporation of perspiration. The third or outer sheet can be of brightly colored and fluorescent materials to provide safety markings for those working on a highway and in other hazardous locations. Although the fluorescent material worn by itself, or over ordinary clothing, would normally impede evaporation, and be uncomfortable to wear in warm weather, the undergarment of this invention prevents that result by providing the wicking action of the first sheet in combination with the evaporative space provided by the web between the first and third sheets.

The ventilation provided by the inner garment of this invention is particularly effective in overcoming reluctance to wear protective armor, such as bullet-proof vests, which inhibit evaporation of perspiration.

I claim:

1. An inner garment for aiding evaporative cooling comprising a first sheet of cloth having an inner face and an outer face and containing a substantial portion of cotton, the first sheet being adapted to be worn with its inner face next to the skin where it will act as a wick for perspiration, a second sheet in the form of a web having a major plane and being disposed adjacent the outer face of the first sheet, the web including a plurality of web filaments interwoven to leave openings with dimensions in the major plane substantially greater than the transverse dimensions of the filaments, and means for holding the web in a wrinkled condition with portions of the web filaments displaced out of the major plane of the web to give the web an effective thickness at least several times greater than the transverse dimensions of the web filaments to form a substantial air space between the first sheet and any outer garment worn over the inner garment.

2. A garment according to claim 1 in which the first sheet contains at least 20% cotton by weight.

3. A garment according to claim 1 in which the openings in the web have mutually perpendicular dimensions at least 3 times greater than the transverse dimensions of the web filaments.

4. A garment according to claim 1 in which the web filaments are displaced out of the major plane to form laterally spaced ribs.

5. A garment according to claim 4 in which the ribs are held in place by tension filaments extending transverse to the ribs and being secured to the crests of the ribs.

6. A garment according to claim 5 in which the tension filaments are elastic.

7. A garment according to claim 1 which includes a third sheet disposed over the outer face of the web.

8. A garment according to claim 7 in which the third sheet is made of woven thermoplastic fibers.

9. A garment according to claim 8 in which the third sheet contains a plurality of openings extending through it.

10. A garment according to claim 7 in which the first and third sheets are secured together at their edges to form an envelope which encloses the web.

11. A garment according to claim 1 in which the web is secured at its side and top edges to the first sheet.

12. A garment according to claim 11 in which the web is unsecured over the major portion of its surface with respect to the first sheet to permit relative movement between the web and the first sheet.

13. A garment according to claim 7 in which a major portion of the web surface is free to slide with respect to the first and third sheets.

14. A garment according to claim 7 in which the first sheet is more hydrophilic than the third sheet.

* * * * *